US005979940A

United States Patent [19]

Araghi

[11] Patent Number: 5,979,940

[45] Date of Patent: Nov. 9, 1999

[54] BOOK HOLDER

[76] Inventor: Behrooz Araghi, 23 Kenburn Avenue, Cherrybrook, New South Wales 2126, Australia

[21] Appl. No.: 08/925,289

[22] Filed: Sep. 8, 1997

[30] Foreign Application Priority Data

Sep. 9, 1996 [AU] Australia ..... PO2213
Dec. 24, 1996 [AU] Australia ..... PO4386

[51] Int. Cl.[6] ..... A47B 97/04

[52] U.S. Cl. ..... 281/45; 248/441.1; 248/453; 281/42

[58] Field of Search ..... 281/42, 45, 43, 281/47; 248/441.1, 446, 453

[56] References Cited

U.S. PATENT DOCUMENTS

| | | | |
|---|---|---|---|
| 3,991,967 | 11/1976 | Sack | 248/448 |
| 4,275,863 | 6/1981 | Hartman | 248/448 |
| 4,436,271 | 3/1984 | Manso | 248/460 |
| 5,199,680 | 4/1993 | Rivera | 248/441.1 |
| 5,302,014 | 4/1994 | Hobson | 312/249 |
| 5,375,806 | 12/1994 | Debus et al. | 248/452 |
| 5,445,416 | 8/1995 | Zareck | 281/42 |
| 5,615,856 | 4/1997 | Simnington | 248/452 |
| 5,649,683 | 7/1997 | Ahn | 248/453 |
| 5,707,036 | 1/1998 | Dunbar | 248/447.2 |

*Primary Examiner*—Andrea L. Pitts
*Assistant Examiner*—Mark Williams
*Attorney, Agent, or Firm*—Ladas & Parry

[57] ABSTRACT

A book-holding apparatus includes a spine support member, a supporting device, and a page restraining device. The spine support member engages with the spine of the book. The supporting device supports the book by interengaging with the front and back cover of the book when the book is in an open position. The supporting device is deflectably coupled to the spine support member. The page restraining device restrains the pages of the book between the restraining device and the book supporting device. Preferably, the spine support member comprises first and second substantially cylindrical members telescopically interengaged so that the spine support member can be adjusted to accommodate a range of spine lengths for books. The apparatus may further include a book restraining device that restrains and trains the spine of the book in relation to the spine support member as pages of the book are turned. Preferably, the book support device includes deflectable book support members having substantially flattened surfaces at one end thereof and being flexibly coupled to the spine support member at the opposite end thereof, and the book support members are configured in relation to the spine support members so as to hold the book in a substantially flat configuration when opened. The page restraint device may include page restraint members each pivotally connected to a respective one of plural restraint arms, whereby portions of the book are held in place by the corresponding page restraint member. The book holder may also be rotatably coupled to an arm member, where the arm member holds the book holder at a fixed position relative to a base member.

7 Claims, 10 Drawing Sheets

BOOK HOLDER

The present invention is directed to a book holding device, and, in particular to a book holding device that it is able to hold different sized books and to be positioned at a plurality of different positions for ease and convenience in reading, such as sitting, lying down on one's back or side, or the like.

BACKGROUND

Many readers find it difficult to maintain manually a book at a desired reading position for prolonged periods of time. Often, a person may hold a book at a particular position due to the positioning of their body, the angle of light in relation to the surface of the book pages, and other environmental parameters causing it to be uncomfortable or difficult to maintain. Other factors affecting the ability to maintain a book at a fixed reading position for a substantial period of time include the size and shape of the book. Another difficulty of manually holding a book is maintaining proper page positioning, especially where environmental parameters such as wind tend to turn the book pages.

These circumstances are further exacerbated when the reader is not able to maintain the book at a fixed position due to independent physical factors affecting the reader. For example, an ill person may find it difficult to hold a book for any prolonged period of time whilst bedridden. In such circumstances, the reader while mentally capable of reading and wishing to do so may find it difficult to read a book due to reduced physical capacity to handle the book, Consequently, the person may not be able to do so.

Potentially more detrimental to a reader is the common experience of readers of holding a book at odd positions that cause physical discomfort because of the positioning of the person's body. For example, if the book is not positioned at an optimal position and orientation from the reader for proper focusing of the person's eyes, this circumstance may lead to eye strain.

Still further, invalids can have problems when attempting to read a book in that often they are unable to hold the book or to turn its pages when required as their use of their arms may be restricted. This means that a number of invalids who would be able to enjoy reading are unable to do so as it is not practical for the person to manipulate the book. The foregoing is merely indicative of the reasons arising for the need to provide a book holding device that will enable a reader to maintain a book at an adjustable position.

Thus, a need clearly exists for a book holding device that is able to ameliorate or overcome one or more of the hereinbefore mentioned disadvantages of the prior art.

SUMMARY

In accordance with one aspect of the present invention, there is provided an apparatus for holding a book comprising:

a spine support member for engagement with the spine of the book, means for supporting the book by interengagement with the front and back cover of the book when the book is in an open position;

page restraining means for restraining the pages of the book between the restraining means and the book supporting means.

Preferably, the spine support member comprises first and second substantially cylindrical members telescopically interengaged, wherein the spine support member can be adjusted to accommodate a range of spine lengths for books.

Still further, the apparatus preferably comprises book restraining means for restraining and training the spine of the book in relation to the spine support member as pages of the book are turned. Optionally, the book restraining means comprises first and second book restraining members each at opposite ends of the spine support member, wherein each book restraining member further comprises an elongated flexible protruding member for interengagement with the book.

Preferably, the book support means comprises a plurality of deflectable book support members having substantially flattened surfaces at one end thereof and being flexibly coupled to the spine support member at the opposite end thereof;

the book support members being configured in relation to the spine support members so as to hold the book in a substantially flat configuration when opened.

Preferably, the page restraint means comprises a plurality of page restraint members each pivotally connected to a respective one of plural restraint arms, whereby portions of the book are held in place by the corresponding page restraint member.

Optionally, the apparatus comprises lamp means for illuminating the pages of the book.

Preferably, the book holder is rotatably coupled to an arm member, where the arm member holds the book holder at a fixed position relative to a base member.

In accordance with another aspect of the present invention, there is provided a book holder comprising:

a substantially flat support;

a top end and a bottom end being substantially parallel to each other;

book holder pins protruding towards each other from both said top and bottom ends to hold a book between same; and page detent pins protruding towards said book from at least one of said top or bottom ends to prevent pages of said book from inadvertently being turned.

Preferably, the top and bottom ends are moveable relative to each other to vary the distance between them to accommodate books of differing spine length (or height).

Preferably, the page detent pins include at least some resilient pins. Further, the book holder may be mounted on an articulated mounting arm which is preferably able to be clamped to a stationary object.

BRIEF DESCRIPTION OF DRAWINGS

Embodiments of the present invention are described hereinafter with reference to the drawings, in which.

DETAILED DESCRIPTION

The present invention provides an apparatus for holding books. In the following description, numerous specific details are set forth in order to provide a more thorough description of the present invention. It will be apparent, however, to a person skilled in art that the present invention may be practiced without one or more of these specific details. In other instances, well-known features have not been described in detail so as not to obscure the invention.

FIRST EMBODIMENT

Figure 1:
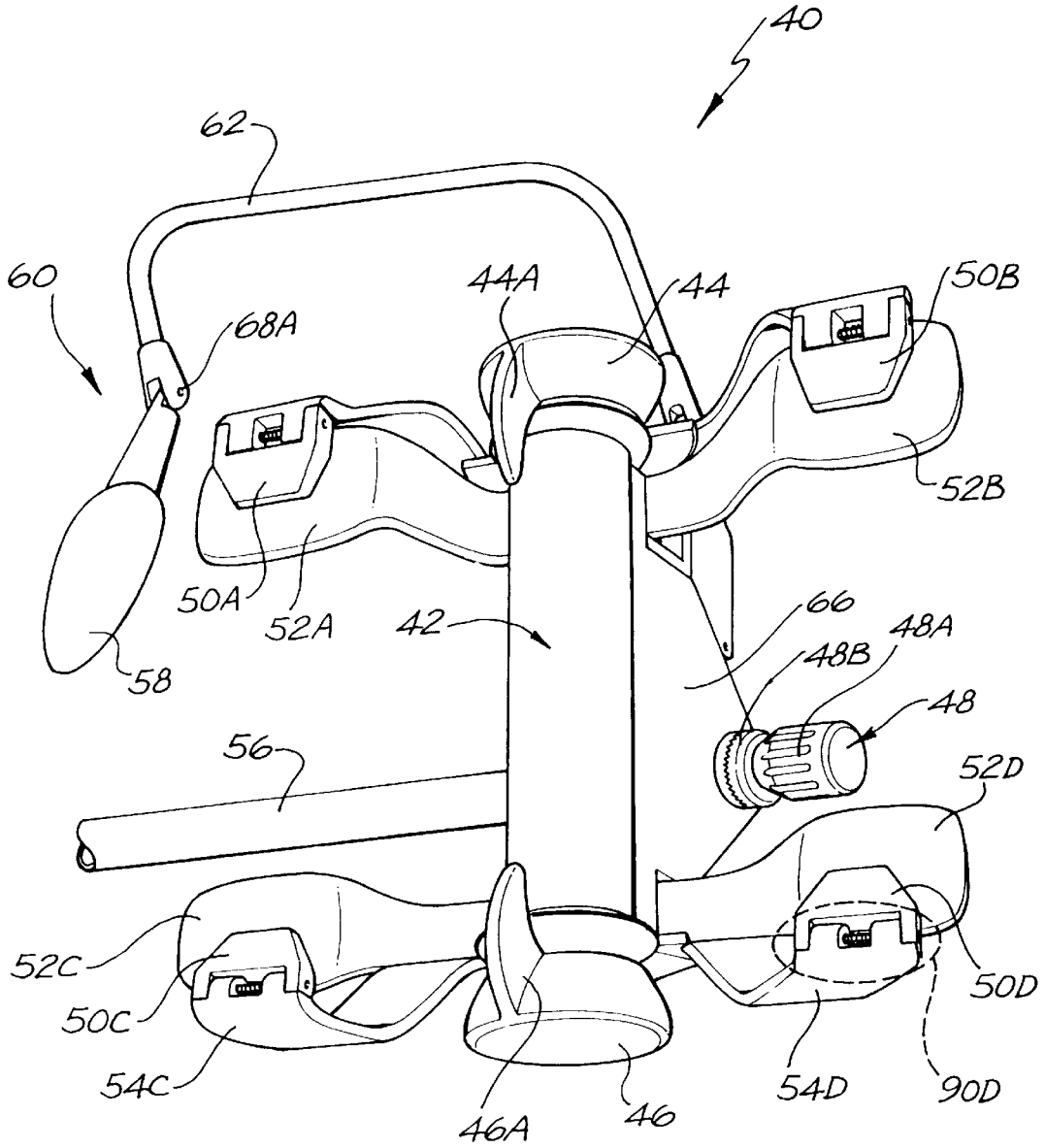
FIG. 1 is a perspective view of a book holder according to a first embodiment of the invention.
Figure 3:
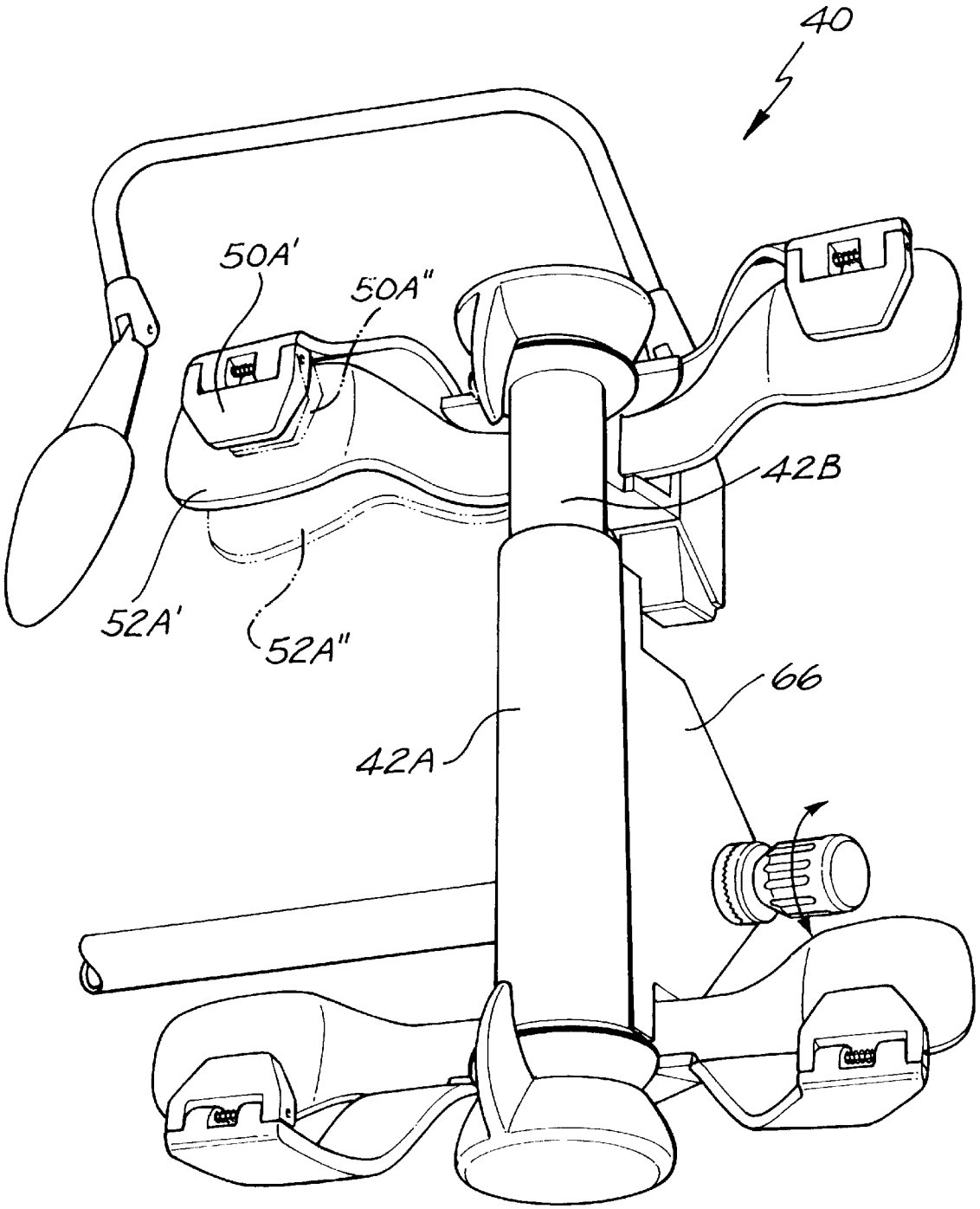
FIG. 3 is a perspective view of the book holder of FIG. 1 with the telescopic, page turning, spine support member in an extended state illustrating movement of the pivotable page restraints and book support member.

FIGS. 1 and 3 are perspective views of the book holder 40 according to the first embodiment. Throughout the drawings, like elements are indicated with the same reference numeral. The book holder 40 comprises a spine support member 42, book restraining members 44 and 46 at the upper and lower ends of the spine support member 42, four book support members 52A to 52D, a body member 66 restraint arm members 54A to 54D, and pivotable page restraints or page deflectors 50A to 50D. The book holder 40 is adjustably connected to a stand (not shown) by arm 56. Optionally, the page holder also comprises a lamp 60.

Figure 6:
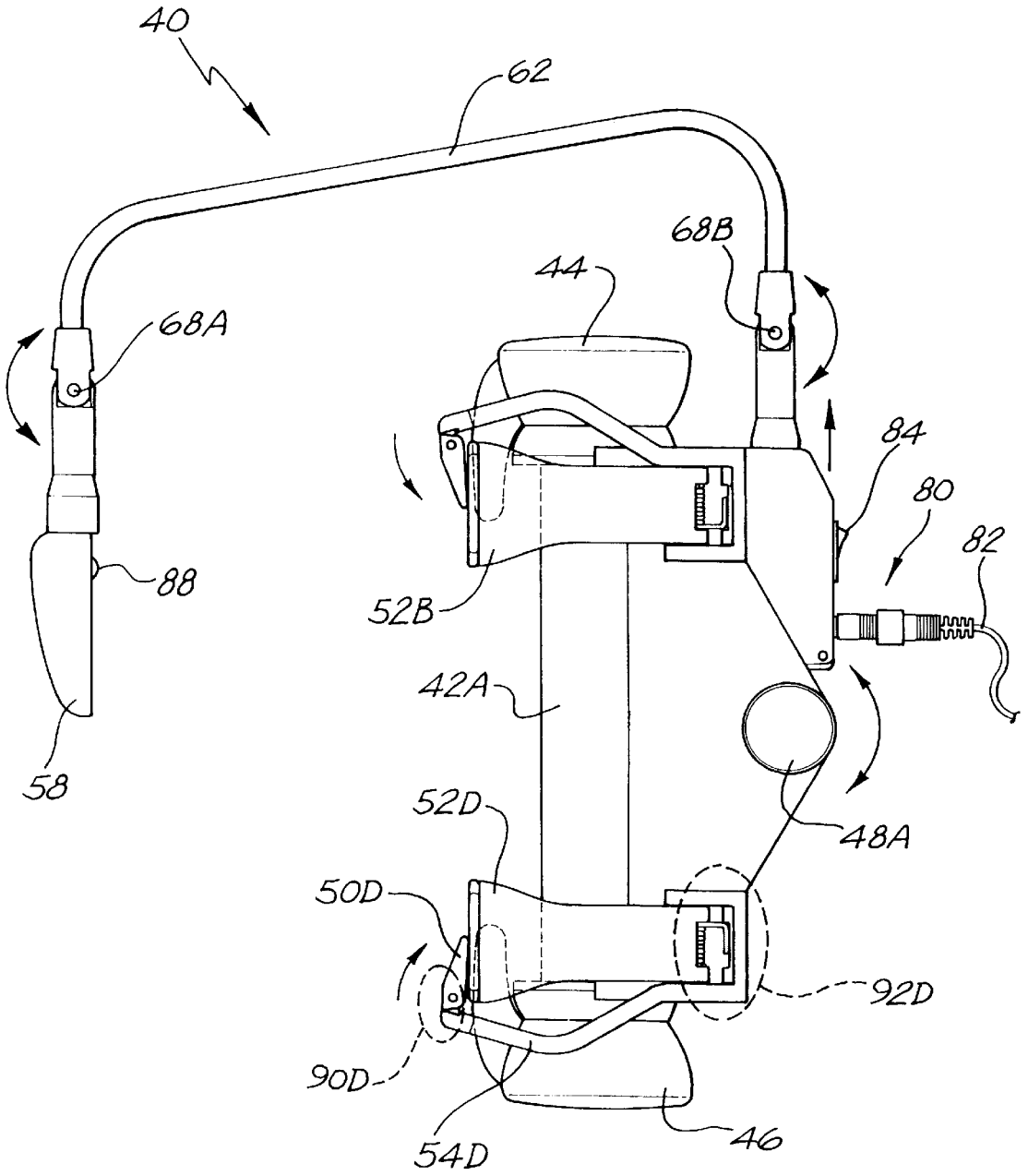
FIGS. 6 and 7 are side elevation views of the book holder of FIG. 1 in a first position with the spine support member in a collapsed state and in an extended state, respectively.

Preferably, the spine support member 42 is a substantially cylindrical, moulded part connected to the body member 66. As shown in FIGS. 1 and 6, the side profile of the body member 66 is substantially wedged shaped and is configured to extend from the rearward side of the spine support member 42 along its longitudinal extent. The spine support member 42A and the body member 66 are preferably an integrally formed structure. The body member 66 has a cavity formed therethrough for receiving the arm 56 of the stand.

The spine support member 42 also comprises an internal cylindrical shaft 42B that can be used to adjustably displace the upper portion of the book support 40 from the lower portion thereof. While the lower portion of the book holder 40 is fixed in relation to the arm 56, an alternate embodiment may fix the upper portion of the book holder 40 to the body 66 and allow the lower portion of the spine support member to be telescopically extended.

A book restraining member 44, 46 having a protruding prong or finger 44A, 46A is located at each end of the spine support member 42. In the first embodiment, the book restraining members 44, 46 each have a frusto-conical shape with a lower protruding lip between the spine support member 42 and the distal ends of the book restraining members 44, 46. The protruding prongs 44A, 46A project inwardly towards the middle section of the spine support member 42 in relation to the book restraining member 44, 46. As shown in FIG. 1, the prong 44A, 46A is preferably integrally formed with the respective book restraining member 44, 46. While the prong 44A, 46A is preferably formed integrally with the respective book restraining member 44, 46, changes may be made to the book restraining member and the corresponding prong without departing from the scope of the present invention. For example, the prong 44A may be a separate member made from a rigid material and flexibly connected to the book restraining member 44 by a pivoting spring assembly (not shown).

A forked restraint member is provided at the upper and lower ends of the book holder 40 to provide upper arms 54A and 54B and lower arms 54C and 54D, respectively.

The book holder preferably comprises four pivotable book support members, or book support arms, 52A to 52D. The book support members 52A to 52D are pedal like in shape and have flattened portions at the distal ends for contacting respective covers of a book. As shown in FIG. 6, the book support members 52A to 52D are preferably connected within the restraint member by means of a pin and torsion spring assembly. Because of the pin and torsion spring assembly, each of the book support members 52A to 52D is capable of being flexibly rotated to enable a book to be positioned in the book holder. Alternative structures may be practiced to enable flexible deflection of the book support members 52A to 52D without departing from the scope and spirit of the invention.

The terminal end of each of the restraint arm members 54A to 54D has a toothed profile, preferably consisting of two rectangular projections. A notch is formed at each end of the toothed sections to allow a respective page restraint or page deflector 50A to 50D to be connected therewith. As shown in FIG. 1, the page deflector 50A to 50D is preferably wedge shaped and formed with a rearward, notched portion. The rearward end of the pivotable page restraints 50A to 50D and the corresponding toothed portions of the restraint arm members 54A to 54D are pivotally connected together by means of a torsion spring between the toothed portions and an elongated pin passing through the noted assembly.

As shown in FIG. 3, the page restraint 50A, for example, can be pivoted from a lower position 50A" (indicated by dashed lines) to an upper position 50A' (indicated by solid lines), or vice versa. Likewise, the book support member 52A can be pivoted from a lower position 52A" to an upper position 52A'.

Figure 5:
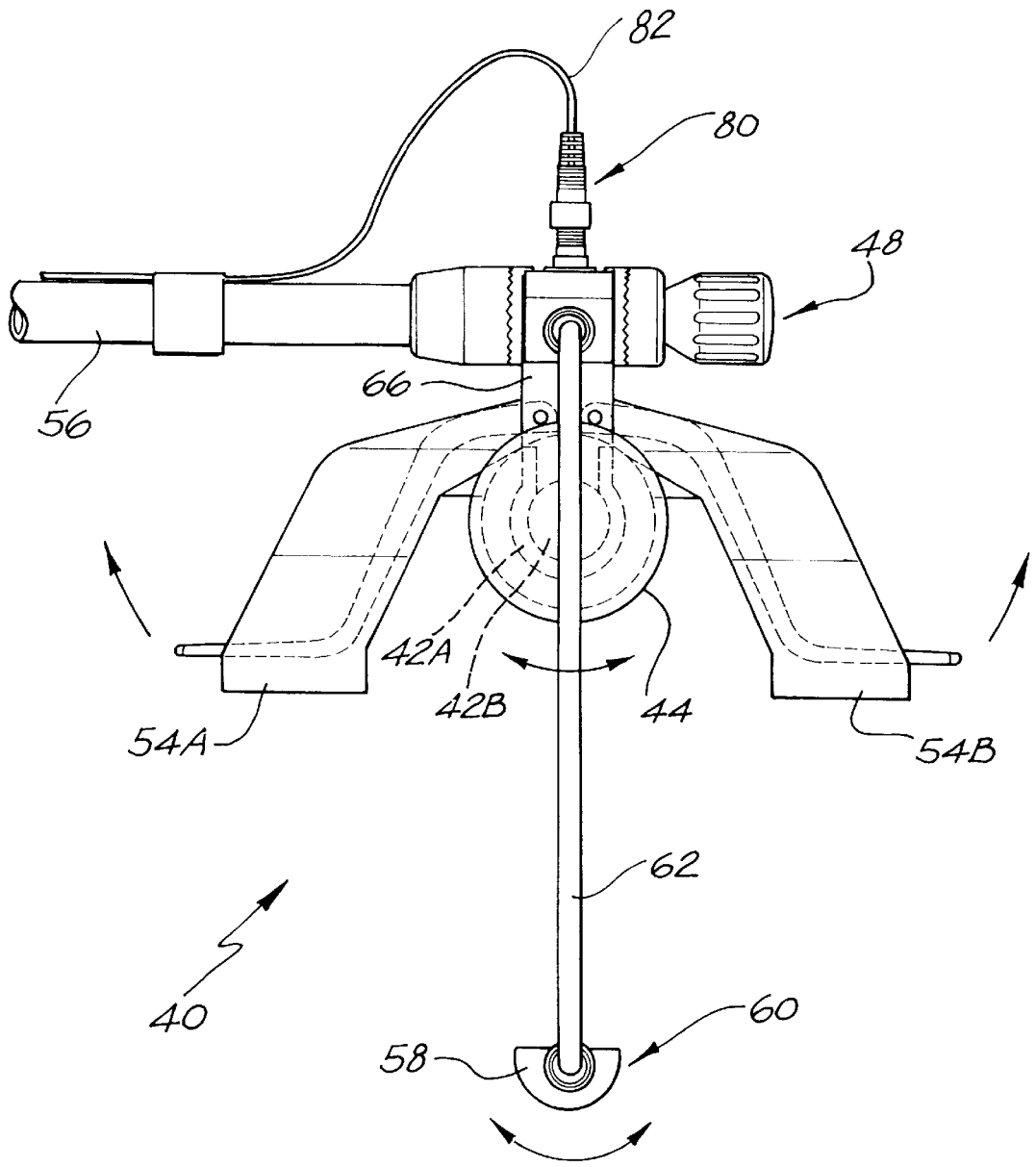
Figure 7:
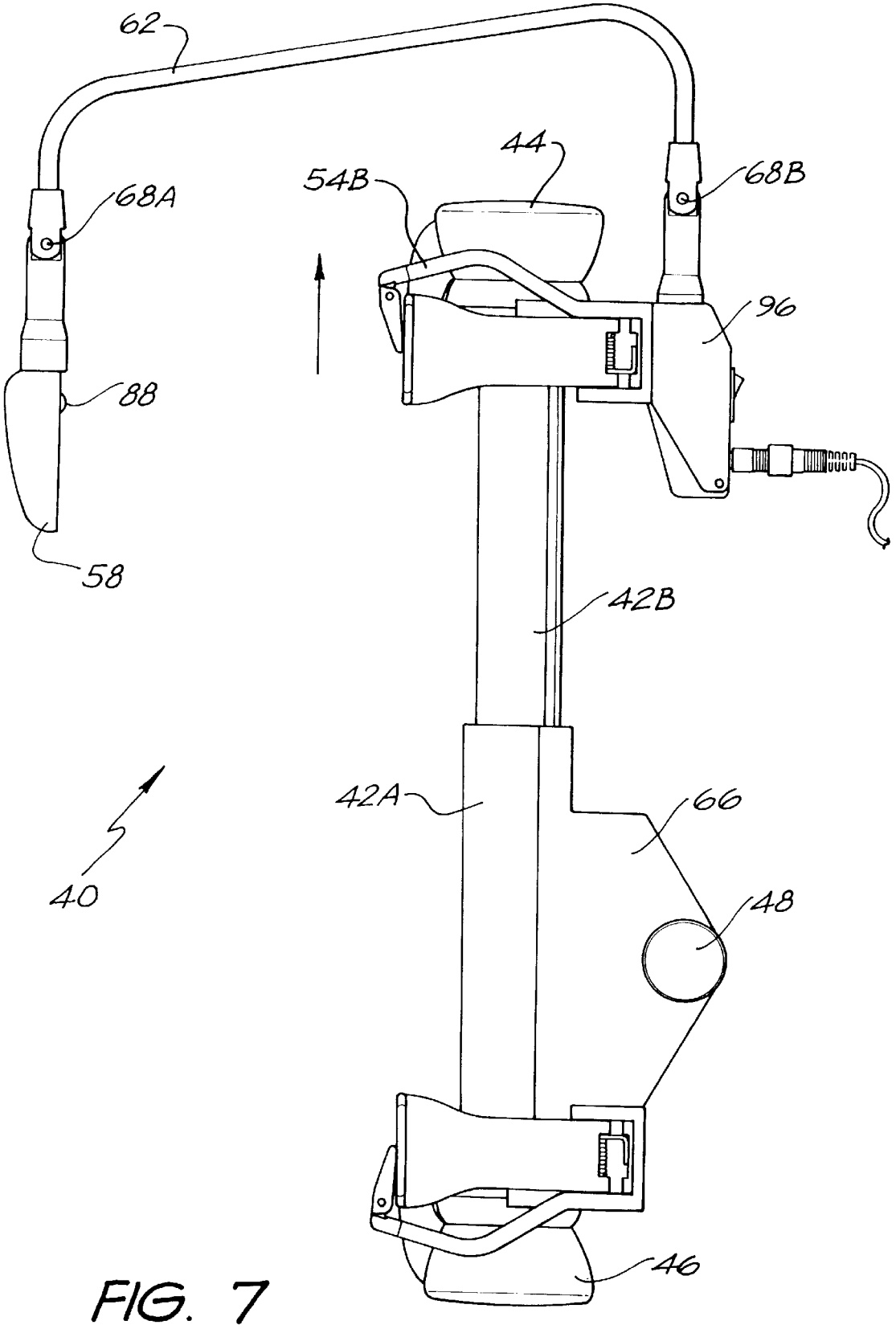

A lamp 60 may optionally be provided with the book holder 40. As shown in FIGS. 1 and 7, the lamp 60 is connected to a rearward base portion 96 connected to the bottom, or rearward, side of the upper restraint member. Preferably, the lamp 60 comprises two pivotable, slot-and-groove assemblies 68A and 68B at opposite ends of lamp arm 62 to allow adjustably pivotable positioning of the lamp in relation to the book holder 40. The terminal end of the lamp 60 comprises a hood 58, which may optionally have a reflective interior surface (not shown), and a bulb 88 disposed therein, As shown in FIGS. 6 and 7, the rearward body portion 96 has a switch 84 incorporated therein for operation of the lamp 60. Electrical power is preferably provided to the lamp via an electrical connector 80 and electrical lead 82 from a remotely located power source. The electrical lead 82 is preferably connected to the rearward side of the arm 56 (see FIG. 5). The electrical lead 82 optionally may be connected to a mains power supply point. Alternatively, a battery may provide electrical energy for operation of the lamp. Numerous variations for the provision of the electrical power to the lamp may be made without departing from the scope and spirit of the present invention. Alternatively, provision could be made to incorporate a battery(ies) within the book holder 40 to power the lamp 60.

Figure 4:
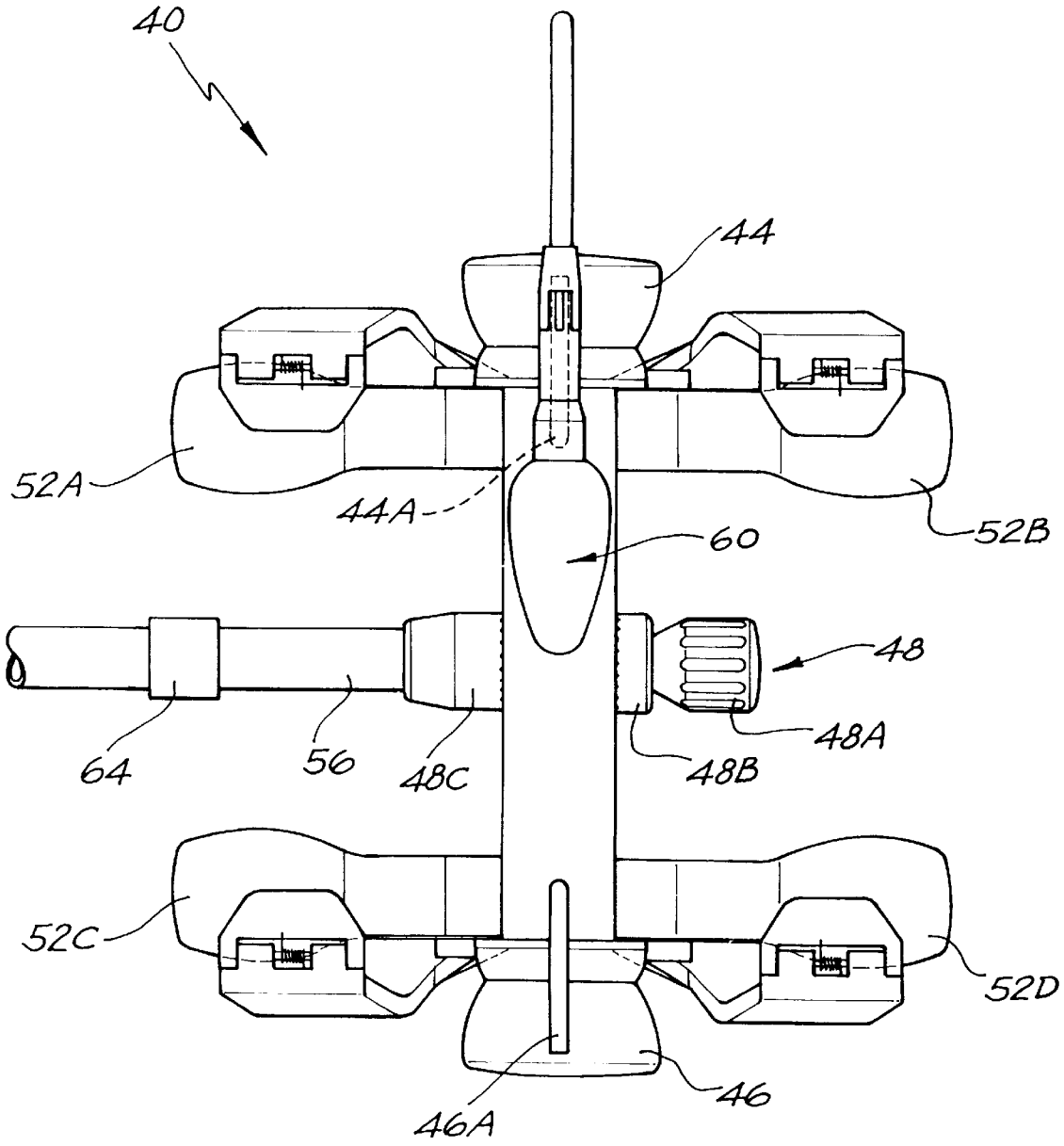
FIGS. 4 and 5 are front-elevation and top-plan views of the book holder of FIG. 1.

As shown in FIG. 4, the book holder 40 is preferably connected to the arm 56 by means of a saw-tooth clamping assembly 48. The assembly 48 consists of a knob 48A connected to a saw-tooth clasping member 48B on one side of the body member 66. Connected to the arm 56 at the other end is a matching saw-tooth member 48C. By twisting the knob 48A in one direction, the clamping assembly 48 is loosened, thereby allowing the book holder 40 to be rotatably adjusted in relation to the arm member 56. The book holder 40 can be adjusted at different angles in relation to the arm 56 and then locked in position by twisting the knob 48A in the opposite direction.

Figure 2:
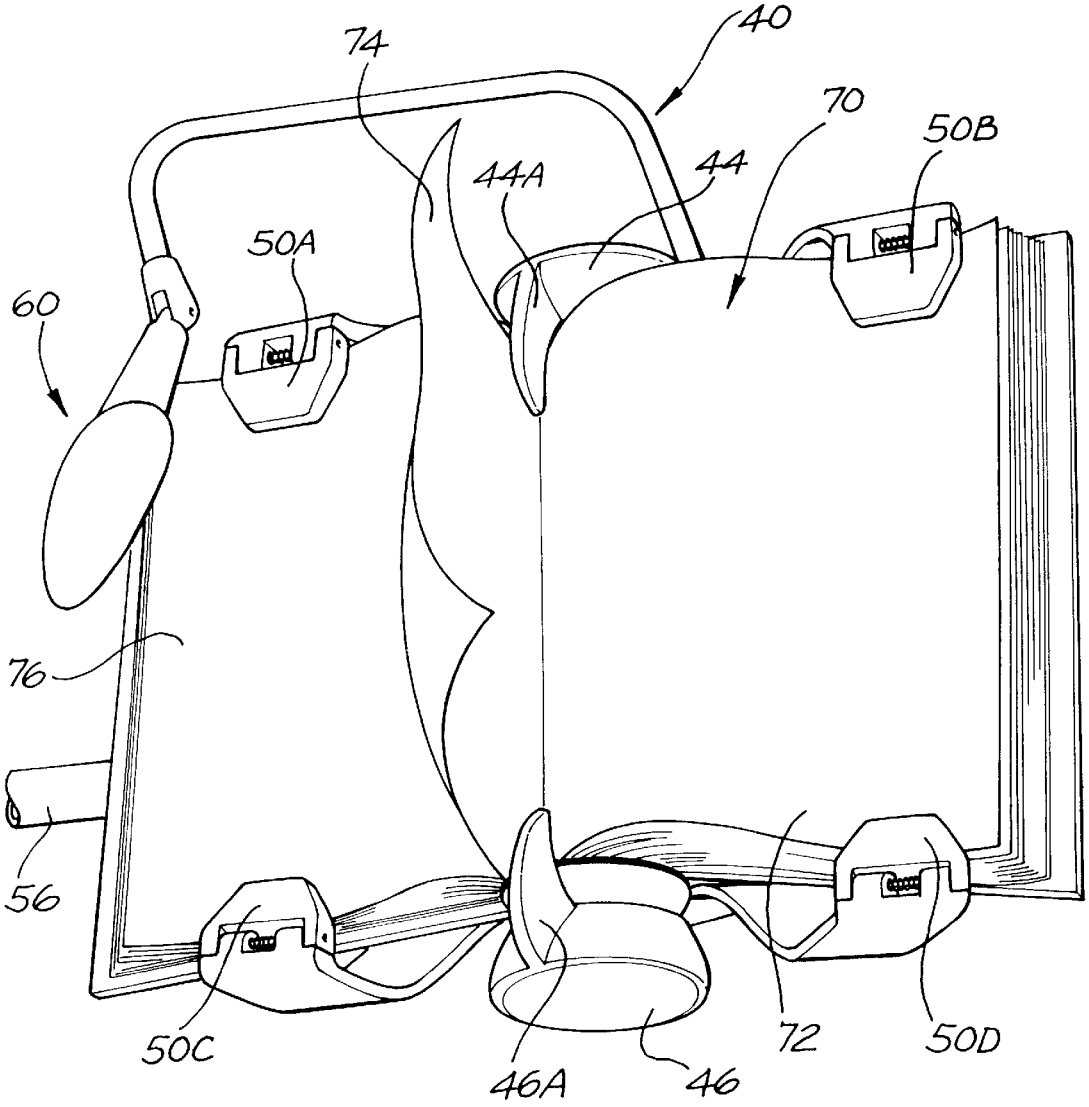
FIG. 2 is a perspective view illustrating a book disposed in the book holder of FIG. 1.

FIG. 2 illustrates the book holder 40 in use with a book 70. In the case where the length of the book's spine is greater than the length of the spine support member 42 in its collapsed state, the telescopic support spine member 42B is first extended as indicated in FIGS. 3 and 7. The spine of the book (not shown) is then placed upon the spine support member 42 and the telescopic spine support members 42A and 42B are collapsed so that the prongs 44A and 46A of the book restraining members 44 and 46 are inserted into, and overlap, the crease between the open pages 73, 74 of the book 70.

As is apparent from FIG. 2, the spine of the book 70 is trained to curve with the curved outer surface of the spine support member 42. By pressing on the opened pages of the book 70, the respective covers of the book cause book support members 52A and 52C on the one hand and book support members 52B and 52D on the other to be deflected or pivoted downwardly. The pivotable page restraint members 50A to 50D are deflected when the book is pressed downwardly and then nove to overlap portions of the opened pages of the book. In this manner, the book holder 40 firmly holds the pages of the book open between the flexible page restraints 50A to 50D and the respective book support member 52A and 52D. In particular, the book restraint members 44, 46 restrain the book against the spine support member 42. As shown in FIG. 2, the page 74 for example can be flicked from the either the left or right hand side of the book from under the respective page restraints 50A to 50D.

As the prongs 44A and 46A insert inwardly between the pages 74 and 72, the book restraint members 44 and 46 tend to turn towards the left, for example, as pages 72 and those beneath it are flicked from the right band side of the book 70 towards the left hand side, and vice versa. The page restraints 50A to 50D enable pages to be turned, and as they are turned over to be restrained by the page restraints 50A to 50D.

The major components of the book holder 40 are all preferably made from a rigid material capable of being moulded such as hardened plastic. That is, the spine support member 42, the body member 66, the four book support members 52A to 52D, the restraint members and their corresponding restraint arms 54A to 54D, the page restraints 50A to 50D are all preferably made of hardened plastic. Alternatively, the noted components may be made of metal, or a combination of metal and plastic parts. Numerous other variations may be made thereto without departing from the scope and spirit of the present invention. For example, the page restraints 50A to 50D may optionally be made of hardened rubber.

Figure 8:
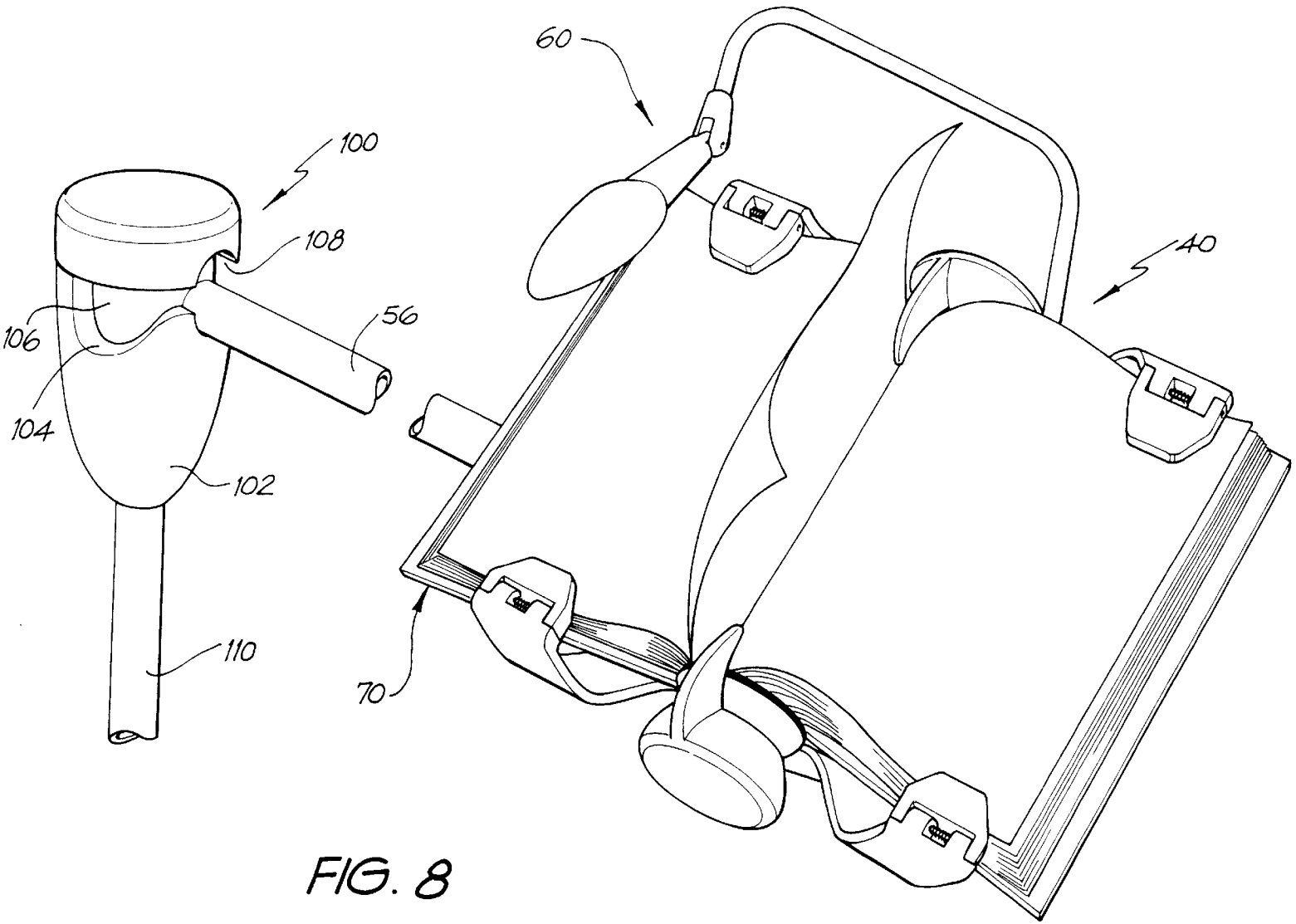
FIG. 8 is a perspective view illustrating the book holder of FIG. 1 including an adjustable stand with an arm connected to the book holder having an articulated elbow at a distal end.

FIG. 8 illustrates the book 70 disposed in the book holder 40, in which the book holder is connected to the upper portion of a stand 100 by means of the arm 56. Only the upper portion of the stand 100 including cylindrical stand body 110 and the articulated elbow 102 that allows arm 56 to be pivotally connected to stand 100. The arm 56 is terminated by a preferably cylindrical body 106 at the end opposite the book holder 40. The articulated elbow 102 is ovoid in shape with a substantially flat upper end. The cylindrical body 102 connected to the arm 56 is disposed in a complementarily shaped cavity in the articulated stand elbow 102, and the arm 56 projects outwardly from recesses 104 and 108. As shown in FIG. 2, the arm 56 is engaged in the recess 108 comprising two substantially semi-circular grooves adapted to match a portion of the cross-section of the arm 56 for secure engagement therewith. The recesses 108 are separated from each other so as to allow the arm 56 to be lifted up out of the lower recess 108 and moved along the contoured, tapered curve of the recess 104 so that the final position of the arm 56 is substantially 90 degrees from the position shown in FIG. 8. This enables a reader to change the position of the book holder 40 to a different orientation. The stand body 110 terminates preferably in a circular pedestal to provide a base for the stand 100. The stand body 110 and the arm 56 are indicated with broken lines or sections so as to emphasise the elbow portion 102 of the stand 100 and simplify the drawing.

The book holder according to the first embodiment has a number of advantages, including that the page turning, spine guide (or trainer) provided by spine support member 42 and book restraining members 44 and 46 protecting the spine of a book. As a result, the book is also in a substantially flat configuration when it is being held open by the book holder 40. The book holder 40 trains the book around the cylinder in a curved manner so that the book is laid out flat. Further, the pages of the book are held in place by the deflective page restraint members 50A to 50D. The spine support member 42 is also adjustable for books of different lengths along their spines. Still further, the book holder 40 is rotatable so that the open pages of the book can be oriented at different relative positions to the reader. Still further, the articulated elbow of the stand allows the book holder to be positioned at a number of horizontal positions relative to the reader. Still further, the book holder 40 reduces significantly wear of books arising otherwise from the normal manual use of books.

SECOND EMBODIMENT

Figure 9:
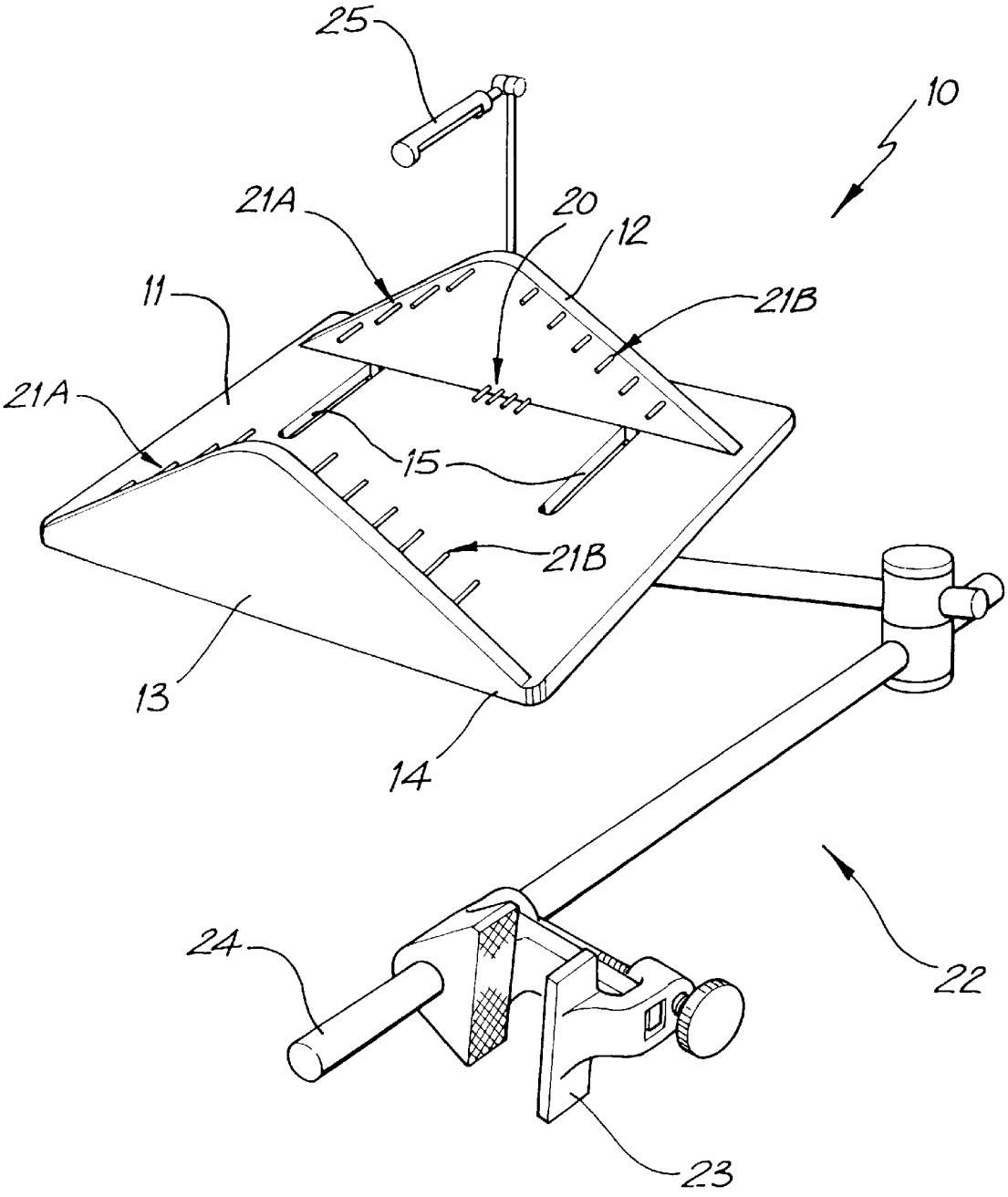
FIG. 9 is a perspective view of a book holder of a second embodiment.
Figure 10:
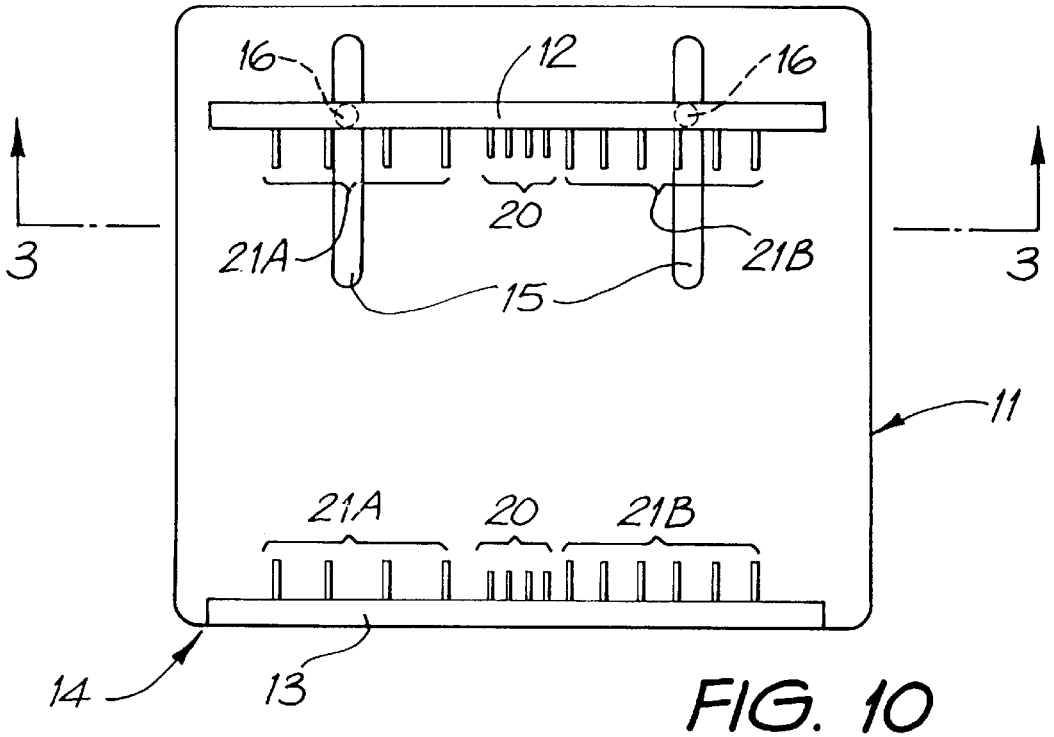
FIG. 10 is a plan view of the book holder of FIG. 9 shown without an articulated arm and a light fitting.
Figure 11:
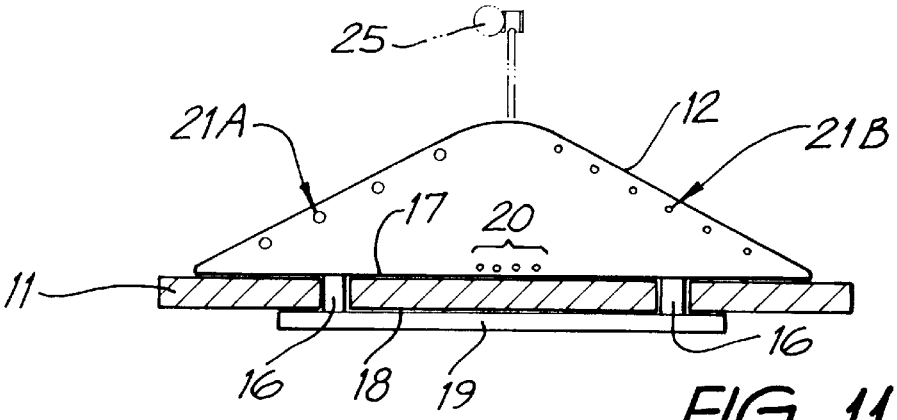
FIG. 11 is a transverse cross-sectional view looking in the direction of arrows 3—3 of FIG. 10.
Figure 12:
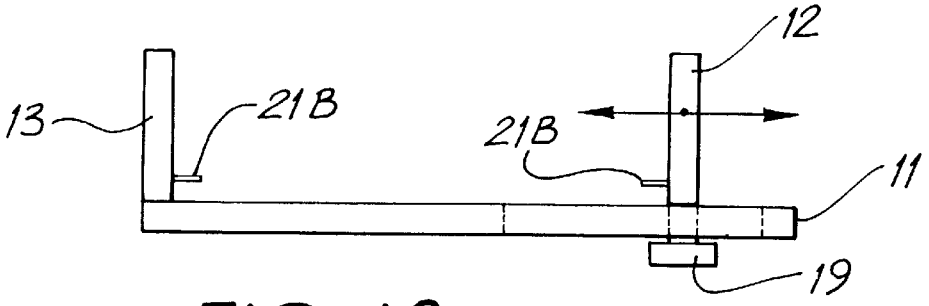
FIG. 12 is a right side view of the book holder as illustrated in FIG. 10.

A book holder 10 according to the second embodiment shown in FIG. 9 includes a substantially flat support panel 11 with a top end 12 and a bottom end 13. Both the top and bottom ends 12 and 13 are substantially triangular shaped plates. The bottom end 13 is perpendicularly fixed to the support panel 11 and it is flush with the bottom edge 14 of the support panel 11, while the top end 12 is slidably engaged within a pair of slots 15 in the support panel 11. Therefore the top end 12 is able to be moved relative to the fixed bottom end 13.

As seen in FIG. 3, the top end 12 is engaged to the support panel 11 by a pair of pins 16 which connect between a lower edge 17 of the top end 12 and an upper edge 18 of a rod 19 which is positioned on the other side of the support panel 11. The pins 16 are able to reciprocally slide within the slots 15 and when a book (not illustrated) is placed on the support panel 11 the top and bottom end 12 and 13 abut against the top and bottom ends of the book respectively with the top end 12 being brought into contact with the book. Therefore the book is sandwiched between the top and bottom ends 12 and 13 with the resistance of the movement of the pins 16 within the slots 15 preventing the book from easily being removed without moving the position of the top end 12.

Both the top and bottom ends 12 and 13 have four book holder pins 20 which are located on the inwardly facing surfaces, substantially adjacent the centre line of the support panel 11 and near the lower edge 17. The book holder pins 20 are substantially rigid and are able to secure the book in position. The preferred number of the pins 20 is in the range 3–6 depending on the size of the book holder 10. This is accomplished by first placing the book in an open configuration abutting the lower edge of the book against the bottom end 13 with the book holder pins 20 protruding into the book between certain pages of the book. The top end 12 is then slid in the direction towards the book until it also abuts against the book in a similar manner where once again the book holder pins 20 protrude into the book. The book in this position is open at the desired page.

The book holder 10 also includes page detent pins 21 which include resilient page detent pins 21A and rigid page detent pins 21B, all positioned facing inwardly from both the top and bottom ends 12 and 13 in a similar manner to the book holder pins 20. In the second embodiment, the rigid page detent pins 21B are located to the right of the centre line while the resilient page detent pins 21A are located to the left of the centre line of the book holder 10. Both types of page detent pins 21 prevent pages of the book from being turned inadvertently. The page detent pins 21 enable the pages to be turned and as they are turned over are held by the resilient page detent pins 21A. The pages are turned by the reader's fingers or, in the case for incapacitated readers, by means of suction or other similar devices (not illustrated). The resilient detent pins 21A enable the pages which have been turned to easily "flicked" back for the reader to peruse what has previously been read.

In the second embodiment described above, there is a combination of either resilient or rigid page detent pins 21A,21B, but in other preferred forms all the page detent pins 21 can be either resilient or rigid if desired.

The book holder 10 also includes in articulated arm 22 which has a clamp 23 at its free end 24. The articulated arm 22 is attached to the back of the support panel 11 in any known way. The articulated arm 22 shown in the drawing is only one particular example which can be used to hold the bookholder 10 in the desired position.

The clamp 23 is able to be clamped to a bed, table, desk, free standing object, and by the manipulation of the articulated arm 22 the book holder 10 can be positioned for the reader, whereby the book held by the book holder 10 can face any direction including face down. The page detent pins 21 prevent the pages on either side from being inadvertently being turned over.

A light fitting 25 as illustrated in FIG. 1 is shown attached to the top end 12. The light fitting 25 is a preferred feature and is used to assist the reader.

The book holder 10 can be used to read a book in different positions, for example, sitting, lying down on one's back or side etc. It has particular use with regard to incapacitated people who would otherwise not be able to read.

The pins 20, 21 can be formed on a backing plate which can be manipulated from one position where the pins 20, 21 protrude inwardly from the ends 12, 13 to another position where they do not protrude.

The foregoing describes only a small number of embodiments of the present invention, and modifications obvious to those skilled in the art can be made thereto without departing from the scope and spirit of the present invention.

I claim:

1. An apparatus for holding a book comprising:

a spine support member for engagement with the spine of said book;

means for supporting said book by interengagement with the front and back covers of the book when the book is in an open position, wherein said supporting means is coupled to said spine support member and is pivotable relative to said spine support member; and page restraining means for restraining the pages of said book between said restraining means and said book supporting means, wherein said spine support member comprises first and second substantially cylindrical members telescopically interengaged so that said spine support member can be adjusted to accommodate a range of spine lengths for books.

2. The apparatus according to claim 1, further comprising book restraining means for restraining the spine of said book in relation to the spine support member as pages of said book are turned.

3. The apparatus according to claim 2, wherein said book restraining means comprises first and second book restraining members each at opposite ends of said spine support member, wherein each book restraining member further comprises an elongated flexible protruding member for interengagement with said book.

4. The apparatus according to claim 1, wherein said book support means comprises a plurality of pivotable book support members having substantially flattened surfaces at one end thereof and being pivotally coupled to said spine support member at the opposite end thereof;

said book support members being configured in relation to said spine support members so as to hold said book in a substantially flat configuration when opened.

5. The apparatus according to claim 1, further comprising lamp means for illuminating the pages of said book.

6. The apparatus according to claim 1, said apparatus being rotatably coupled to an arm member, where said arm member holds said book apparatus at a fixed position relative to a base member.

7. An apparatus for holding a book comprising:

a spine support member for engagement with the spine of said book;

means for supporting said book by interengagement with the front and back covers of the book when the book is in an open position, wherein said supporting means is coupled to said spine support member and is pivotable relative to said spine support member; and page restraining means for restraining the pages of said book between said restraining means and said book supporting means, wherein said page restraint means comprises a plurality of page restraint members each pivotally connected to a respective one of a plurality of restraint arms, whereby portions of said book are held in place by said corresponding page restraint member.

* * * * *